US005257246A

United States Patent [19]

Ehsman

[11] Patent Number: 5,257,246

[45] Date of Patent: Oct. 26, 1993

[54] TIMEKEEPING DISPLAY

[76] Inventor: Patricia M. Ehsman, 32 Ocean View Parade, Charlestown, New South Wales, 2290, Australia

[21] Appl. No.: 847,385

[22] Filed: Mar. 6, 1992

[30] Foreign Application Priority Data

Mar. 8, 1991 [AU] Australia ..... 72778/91

[51] Int. Cl.[5] ..... G04B 37/00

[52] U.S. Cl. ..... 368/282; 368/228; 368/223

[58] Field of Search ..... 368/281, 282, 283, 223, 368/229

[56] References Cited

U.S. PATENT DOCUMENTS

| | | | |
|---|---|---|---|
| 4,858,209 | 8/1989 | Chaut | 368/228 |
| 4,884,256 | 11/1989 | Blackburn | 368/228 |
| 4,999,822 | 3/1991 | Blackburn | 368/228 |
| 5,043,955 | 8/1991 | Dubois et al. | 368/228 |

*Primary Examiner*—Bernard Roskoski

[57] ABSTRACT

A timekeeping display of the type in which a set of hands rotate about an origin and sweep across a face to indicate the time in an analog fashion, wherein the face is divided into a plurality of part-faces each of which retains its spatial relationship to the origin, and which are separated from each other to divide the origin into that plurality of notional origins; and in use, the set of hands appear to rotate about each notional origin and each hand sweeps across each part-face in every revolution.

4 Claims, 3 Drawing Sheets

TIMEKEEPING DISPLAY

BACKGROUND OF THE INVENTION

Analog time displays have been known for many years, and typically indicate passage of twelve hours in one complete revolution of an hour hand. A minute hand is usually provided to define the passage of one hour in a complete revolution. A second hand is optionally provided to indicate the passage of a single minute in a complete revolution.

The hands may be driven by mechanical, electrical or electronic means, and may comprise slender pointers which physically rotate, or they may comprise an array of electronic indicia which are operated to simulate the rotation of points.

FIELD OF THE INVENTION

This invention concerns a timekeeping display of the type in which a set of hands rotate about an origin and sweep across a face to indicate the time in analog fashion.

SUMMARY OF THE INVENTION

According to the present invention, the face of the timekeeping display is divided into a plurality of part-faces, each of which retains its spatial relationship with the origin. The part-faces are separated from each other to divide the origin into a corresponding number of notional origins. In use, the set of hands appear to rotate about each notional origin, and each hand sweeps across each part-face in every revolution.

Displays embodying the invention indicate the time in analog fashion, but provide unusual and attractive displays for watches and other timepieces.

In many embodiments, it is envisaged that the notional origins will be spatially separated by a small distance in order to provide a disjointed display.

The part-faces may be divided from each other by straight or curved lines, by zigzags, or in any other fashion.

In a preferred embodiment, the face is divided into two half faces, for instance, two semi-circular parts. In an alternative embodiment, the face is divided into sectors.

BRIEF DESCRIPTION OF THE DRAWINGS

The invention will now be described by way of example only, with reference to the accompanying drawings, in which.

The same reference numerals have been used throughout the drawings to indicate corresponding elements.

DETAILED DESCRIPTION OF THE PREFERRED EMBODIMENT

Figure 1A:
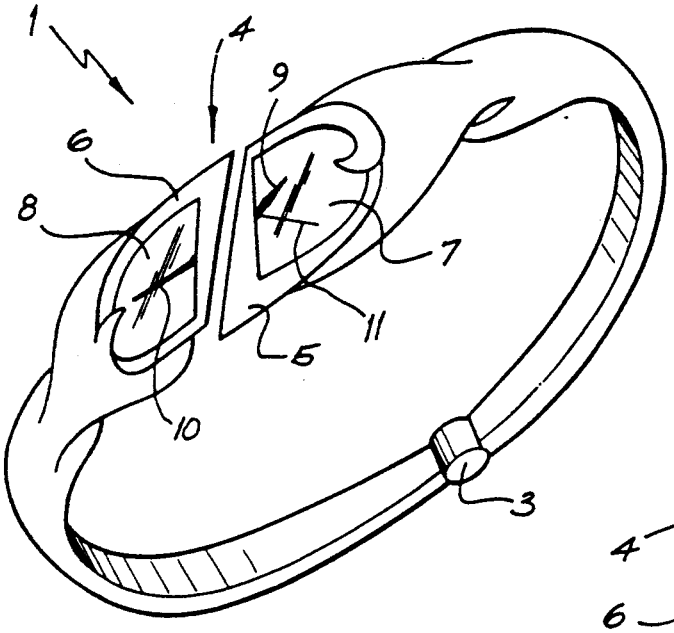
FIGS. 1A and 1B are perspective views and FIG. 1C is a plan view of a first watch embodying the present invention.
Figure 1C:
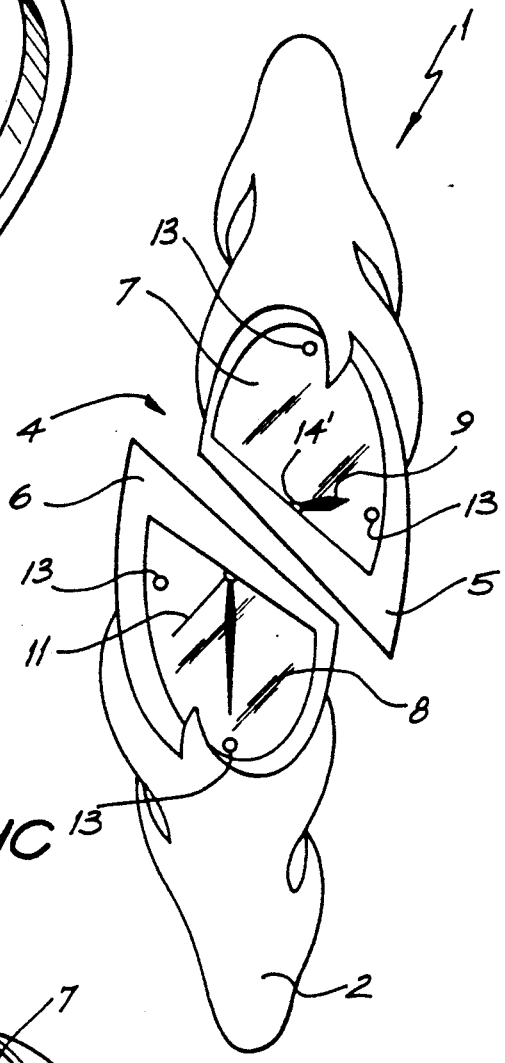
Figure 1B:
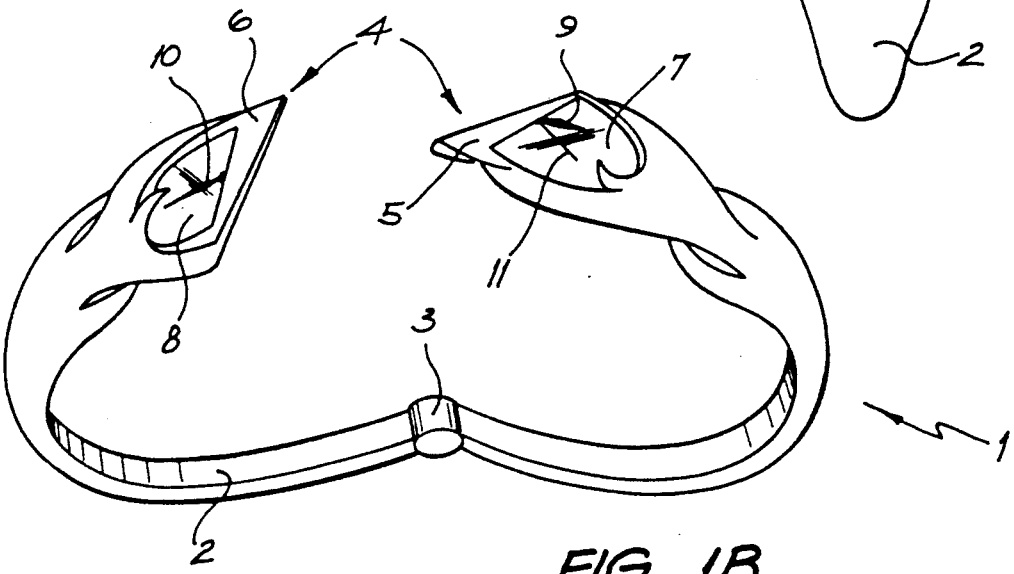

Referring now to FIGS. 1A, 1B and ac, the watch 1 comprises a band 2 which is openable about hinge 3, and a timekeeping display 4.

The display 4 is split into two separate parts 5 and 6. When the watch is being worn, parts 5 and 6 of display 4 are brought adjacent to each other by closing band 2 bout hinge 3 as shown in FIGS. 1A and 1C. To put the watch on and take it off, band 2 is opened about a hinge 3 to separate part 1 and 6 of display 4; as shown in FIG. 1B.

The face of the watch is divided into two parts 7 and 8, one part-face being associated with each part of the display.

An hour hand 9, minute hand 10, and second hand 11 rotate about an origin to indicate the time. Indicia 13 are provided on the face of the watch, best shown in FIG. 1C to facilitate accurate reading of the time.

By way of example, the face of the display may be split as shown, for example, into two identical halves by a straight diagonal line running from approximately ten o'clock to approximately four o'clock. Each of the part-faces 7 and 8 retain their spatial relationships with the origin of hands 9, 10, and 11, that is the hands travel on each part-face and indicate the time of each part-face in the same manner as they would if two faces were undivided from each other and comprised a single united face. But the part-faces have been separated from each other to divide the origin into two notional origins 14′ and 14″.

In use, the set of hands 9, 10 and 11 appears to rotate about both notional origin 14′ and notional origin 14″. In each complete revolution, the hands sweep across both part-faces 7 and 9, the hour hand appearing on part-face 7 from approximately ten o'clock until approximately four o'clock, and appearing on part-face 8 from approximately four o'clock until approximately ten o'clock. Similarly, the minute hand appears on part-face 7 after approximately 'ten to' until 'twenty past', and on each part face 8 after 'twenty past' to approximately 'ten to'. Similarly again, the second hand appears on part-face 7 from fifty seconds to twenty seconds, and on part-face 8 from twenty seconds to fifty seconds.

Figure 2A:
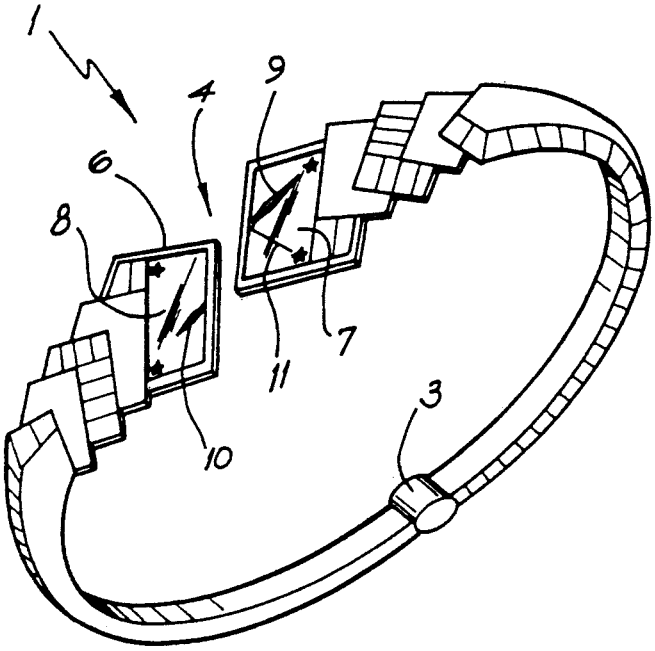
FIGS. 2A and 2B are perspective views and FIG. 2C is a plan view of a second watch embodying the present invention.
Figure 2C:
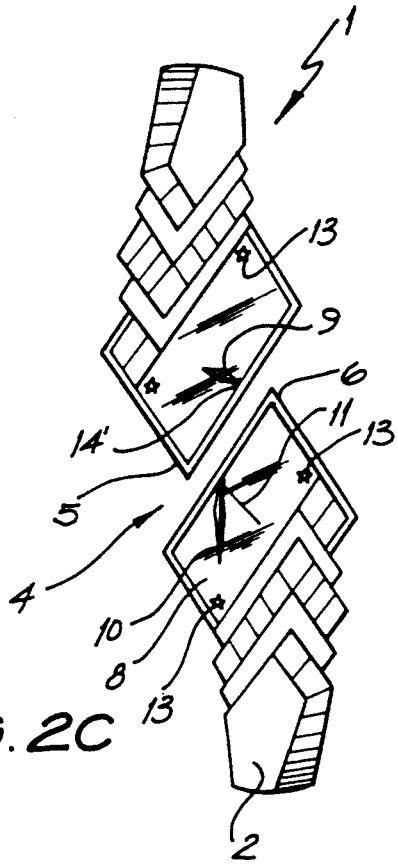
Figure 2B:
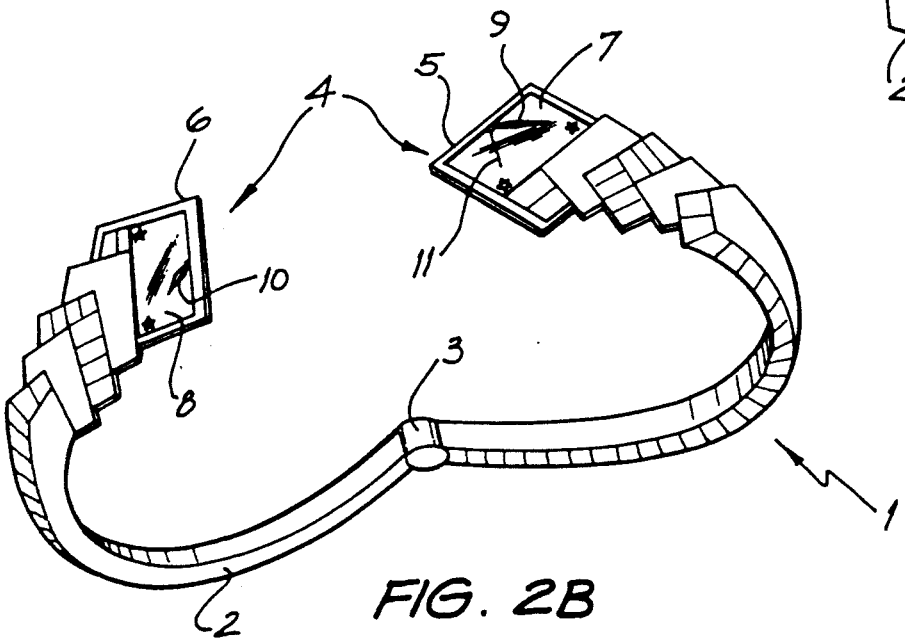
Figure 3:
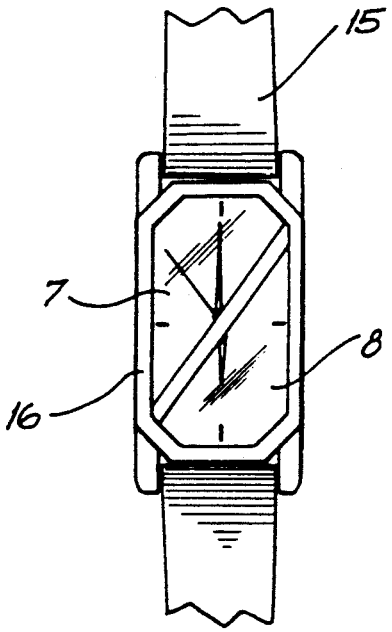
FIG. 3 is a plan view of a third watch embodying the present invention.
Figure 4:
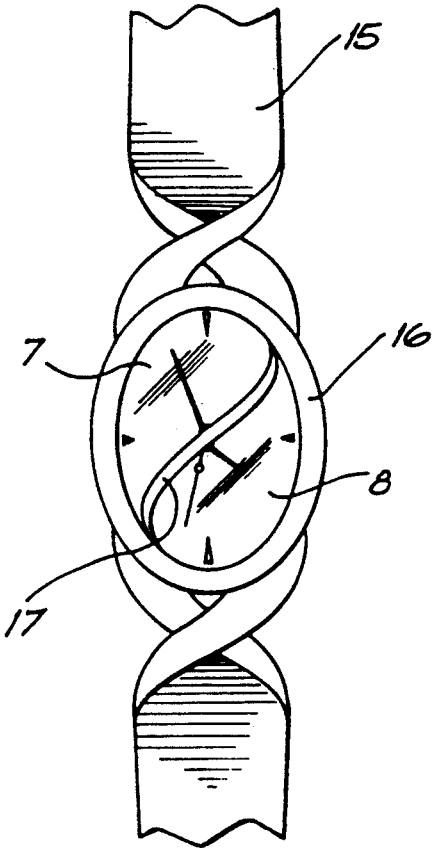
FIG. 4 is a plan view of a fourth watch embodying the present invention.

FIGS. 2A, 2B, and 2C show an alternative embodiment. Parts corresponding to parts in FIGS. 1A, 1B, and 1C have been numbered correspondingly. FIG. 3 and FIG. 4 show two further alternative embodiments in which a conventional watch band 15 is used, and the two part-faces 7 and 9 are held in spaced-apart relationship by a rigid frame 16.

Notably, FIG. 4 shows an example where to the two part-faces 7 and 8 have been divided from each other by a serpentine line, and are spaced apart from each other by a serpentine space 17.

It should be appreciated that many other arrangements of the part-faces are possible, and in fact the arrangements are only limited by the ingenuity of the designer. For instance, the part-faces may comprise sectors arranged like the petals of a flower. The petals may overlap each other and have different radii so that a hand may appear on both of two part-faces simultaneously.

The operation of the display presents a number of challenges to the designer. Perhaps the simplest way to realize a display is using electronics for the display driver, and electronic indicia to simulate the hands. In this case, synchronism can be ensured between the two half faces by the use synchronizing signals passing through the wrist band 2, or the frame 16.

Mechanical arrangements are also possible, but this necessitates the provision of a set of hands to each part-face. In this case, either some unobtrusive flyback mechanism must be provided for the hands when they reach the end of each half face, or some hidden path must be provided to allow the hands to complete their revolution unseen. All these artifices, and many others, are considered to be within the ability of a non-inventive skilled watch or clock maker.

What is claimed is:

1. A timekeeping display of the type in which a set of hands rotate about an origin and sweep across a face to indicate the time in an analog fashion;

wherein the face is divided into a plurality of part-faces which are in spaced relation from each other while retaining their respective spatial relationships to the origin, wherein the origin is divided into a plurality of spatially separated, notional, origins;

and in use, the set of hands appear to rotate about each spatially separated, notional origins and each hand sweeps across each part face in every revolution.

2. A timekeeping display according to claim 1 wherein the part-faces are divided from each other by straight lines.

3. A timekeeping display according to claim 1 wherein the part-faces are divided from each other by curved lines.

4. A timekeeping display according to claim 1 wherein the part-faces are divided from each other by zig-zagged lines.

* * * * *